US008006723B2

(12) United States Patent
Williams

(10) Patent No.: US 8,006,723 B2
(45) Date of Patent: Aug. 30, 2011

(54) CONDUCTOR LOOP-FORMING TOOL

(76) Inventor: Gayland M. Williams, Chester, VT (US)

( * ) Notice: Subject to any disclaimer, the term of this patent is extended or adjusted under 35 U.S.C. 154(b) by 0 days.

(21) Appl. No.: 12/779,990

(22) Filed: May 14, 2010

(65) Prior Publication Data

US 2010/0294392 A1 Nov. 25, 2010

Related U.S. Application Data

(60) Provisional application No. 61/180,145, filed on May 21, 2009.

(51) Int. Cl.
*B21F 3/00* (2006.01)
*H01R 43/033* (2006.01)

(52) U.S. Cl. ..... 140/102.5; 140/123

(58) Field of Classification Search ..... 140/102.5, 140/102, 123, 104, 106; 72/217, 218; 81/DIG. 5; 7/107
See application file for complete search history.

(56) References Cited

U.S. PATENT DOCUMENTS

| | | | | |
|---|---|---|---|---|
| RE6,729 | E | 11/1875 | Cummings | |
| 2,046,837 | A | 7/1936 | Phillips | |
| 2,456,532 | A * | 12/1948 | Perazzo | 140/102.5 |
| 4,257,159 | A | 3/1981 | Wingert | |
| 4,751,840 | A | 6/1988 | Windsor, Jr. | |
| 5,205,006 | A | 4/1993 | Panasuk | |
| 5,309,954 | A | 5/1994 | Franssen | |
| 5,520,227 | A | 5/1996 | Kelley | |
| 5,809,824 | A | 9/1998 | Hiltzman | |
| 5,893,185 | A * | 4/1999 | Okrepkie et al. | 7/107 |
| 5,931,039 | A * | 8/1999 | Yoshimizu et al. | 72/217 |
| 7,703,482 | B1 * | 4/2010 | Tiebout | 140/102.5 |

OTHER PUBLICATIONS

Klein Tools, "Screwdrivers, Nut Drivers & Accessories", downloaded from URL: http://www.kleintools.com/ToolCatalog/PDFs/07_Screw-Nut_Drivers.pdf , pp. 91-92.

* cited by examiner

*Primary Examiner* — Edward Tolan
*Assistant Examiner* — Mohammad Yusuf
(74) *Attorney, Agent, or Firm* — Michael J. Weins; Jeffrey E. Semprebon

(57) ABSTRACT

A loop-forming tool for forming a loop in a conductor has a grip with a first end section having a central post and an off-axis post mounted therein. The two posts are spaced to allow a conductor to pass therebetween and to grip the conductor when the tool is rotated, bending the conductor around the central post to form a U-shape. Rotating the tool in the opposite direction changes the U-shaped hook to a "?"-shaped hook for attaching to a tie-down bolt. Index marks can be provided on a terminal surface of the first end section to facilitate making consistent loops. The relative sizes of the posts can be configured to allow the tool to also serve to wrap the loop around the tie-down bolt, and to provide a screwdriver for subsequently tightening the tie-down bolt to secure the looped conductor thereto.

20 Claims, 11 Drawing Sheets

CONDUCTOR LOOP-FORMING TOOL

FIELD OF INVENTION

The present invention relates to tools used to form loops in an electrical conductor to prepare the conductor for attachment to a tie-down bolt of an electrical terminal.

BACKGROUND OF INVENTION

A number of tools have been designed to address the task of shaping the end portion of a conductor so as to provide a loop suitable for attaching the end of the conductor to a tie-down bolt such as those found on electrical outlets, switches, and similar electrical system components. Some examples of such devices are taught in U.S. Pat. Nos. 4,257,159; 5,520,227; and 5,309,954.

While some of these tools can provide U-shaped loops, they were not suitable for forming "?"-shaped hooks, which are desirable so as to facilitate positioning of the loop around a shank under a retaining head of a tie-down bolt. One tool which apparently could be used to form "?"-shaped hooks is commercially available from Klein Tools, Inc., of Lincolnshire, Ill. This tool resembles a conventional screwdriver or nutdriver, but is provided with a post that is offset from and extending parallel to a shank of the driver. A conductor can be placed between this post and the shank and the tool rotated about a longitudinal axis. When so rotated, the post restrains the end of the conductor, causing the conductor to bend about the shank to form a U-shaped loop. The direction of rotation can then be reversed, which brings a standing portion of the conductor against the post to allow the user to create a reverse bend to change the U-shaped loop into a "?"-shaped hook.

SUMMARY OF INVENTION

The present invention provides a tool for an electrician that can be configured to preform various functions associated with the wiring switches. Depending on the details of the configuration the tool, it can be tailored to provide a consistent size and configuration of a loop or hook and/or to tuck a loop under a retaining head of a tie-down bolt.

The tool can be configured to provide a bending cradle to facilitate the formation of consistently-sized hooks that are properly configured to be readily placed around a shank, under a retaining head, of a tie down post such as are commonly found on electrical system components such as power outlets and switches. Because such tie-down bolts are frequently surrounded by raised walls that limit access to the shank, correct size and shape of the hook is needed to facilitate insertion of the hook under the retaining head of the tie-down bolt without interference.

The tool can be configured to allow the user to readily tuck the conductor under the retaining head of such post before it is tightened to secure the conductor.

In all cases the tool has a grip having a longitudinal grip axis and terminating in a first end section which has a substantially planar grip terminal surface extending normal to the grip axis.

A central post is provided, which has a central post axis that is substantially aligned with the grip axis. The central post has a central post mounting section, which is mounted in the first end section of the grip, and a central post exposed section that terminates in a central post free end which is spaced apart from the grip terminal surface to define an exposed central post height $H_C$. The central post mounting section can be fixably embedded in the first end section, or can be removably mounted in a socket that forms part of the first end section of the grip, while the remainder forms the central post exposed section. The central post exposed section is configured such that it and the substantially planar grip terminal surface, in combination, form a wire bending cradle. This cradle serves to position and bend a terminal portion of the conductor about a portion of said central post exposed section which is configured to provide a substantially circular line of contact with the conductor, this line of contact having a contact radius $R_C$ for the conductor where the contact radius $R_C$ is selected so that the loop formed by bending the conductor about the central post exposed section is properly sized to fit around the shank of a tie-down bolt.

The loop-forming tool has an off-axis post having an off-axis post effective radius $R_O$ and an off-axis post axis that is parallel to the central post axis. The off-axis post has an off-axis post embedded section, which is embedded in the first end section of the grip, and an off-axis post exposed section that terminates in an off-axis post free end, which is spaced apart from the grip terminal surface to define an exposed off-axis post height $H_O$.

The axes of the two posts are spaced apart at a separation S so as to provide a separation sufficient not only to allow the conductor to be passed between the central post and the off-axis post, when the line of contact of the conductor is in contact with the central post, but also of sufficient separation to create a reasonable bending moment so that the conductor can be easily bent around the central post. At the same time, the posts should be sufficiently close as to limit the elastic deformation in the conductor between the posts to assure that it can be bent to form a U-shape by the off-axis post as the tool is rotated about the grip axis. For this to occur, it is necessary before bending that a free end of the conductor be positioned with respect to the off-axis post such that the conductor remains engaged with the off-axis post as the tool is rotated. This creates a U-shaped loop constrained by both posts.

The loop will remain in contact with the central post when the direction of rotation of the tool is reversed. This reverse rotation brings a shank portion of the loop (the portion on the opposite side of the bend from the free end) into contact with the off-axis post, causing the off-axis post to introduce a reverse bend that changes the U-shaped hook to a "?"-shaped hook. This "?"-shaped hook is highly desirable, since it facilitates inserting the loop under a retaining head of a tie-down bolt when the conductor is to be secured, particularly in situations where the accessability of the tie-down bolt is limited. It is preferable in many situations to have the radii of the posts selected such that $R_O$ is less than $R_C$ to provide a smaller bending radius such that the conductor will plastically deform with less rotation when bending against the off-axis post, thereby assuring an offset in the U-shaped structure to form a "?"-shape.

The tool can be configured with means for assuring consistency of the hooks formed by the tool. It is particularly beneficial to provide means for assuring that the free end of the conductor is properly positioned to begin the loop forming process, as this sets the length of the free end extending beyond the bend, referred to hereafter as the "loop tail". The loop tail should be long enough to allow the free end of the conductor to be tucked under the retaining head of the tie-down bolt to assure that the conductor circumscribes the shank of the tie-down bolt sufficiently to maintain it secured thereto in good electrical contact when the tie-down bolt is tightened, but not so long as to impede the insertion of the loop around the shank when access to the tie-down bolt is restricted by surrounding projections. The means for assuring consistency should also provide an index of the bending of the conductor to provide an appropriate breadth of loop for engagement with the shank of the tie-down bolt; typically, a 180° bend is desired. The grip terminal surface provides a platform on which the conductor is placed so that it is in contact with the central post and the off-axis post, thereby forming a cradle for holding the conductor.

The means for assuring consistency can be provided by index marks on the grip terminal surface that serve as visual guides for the placement and bending of the conductor. A first index mark can serve to provide means for positioning the conductor if the first index mark is located relative to the posts such that, when the free end of the conductor is placed over the first index mark and the conductor passes between the central post and the off-axis post, the conductor will be engaged by the posts and bent around the central post as the tool is rotated to form a hook with the end of the hook extending a desired hook length $L_H$ for eventually securing to a tie-down bolt. A second index mark can provide means for indexing the bending if positioned such that, when the tool is rotated, the shank portion of the loop will pass over the second index mark when the desired initial U-shape has been formed (typically, a 180° bend is desired). Thereafter, the tool can be rotated in the opposite direction until the shank portion of the loop is oriented so as to substantially intersect the central post axis; this position can be indicated by a third index mark, which aligns with the conductor when rotation of the tool in the opposite direction has created the desired amount of reverse bend. To allow the tool to be used either right-handed or left-handed, mirrored index marks can be provided that are reflected across the plane of the two post axes.

While the tool as described above has significant benefit over the prior art loop-forming tools, the utility of the tool can also provide a benefit, whether or not the grip terminal surface is configured as discussed above, by adjusting the heights of the central post exposed section and the off-axis post exposed section so as to enable the tool to provide a winding function. To provide such, the relative heights of the posts are adjusted such that the exposed height $H_O$ of the off-axis post exposed section is shorter than the exposed height $H_C$ of the central post exposed section, with the difference in height being such that, when the off-axis post is engaged with a retaining head of a tie-down bolt about which the conductor loop is placed, the central post extends a sufficient distance below the retaining head to engage the conductor when the tool is rotated while being positioned such that the axes are substantially normal to a tie-down substrate from which the tie-down bolt extends. This allows the central post to forcibly engage a portion of the conductor that extends beyond the retaining head as the tool is rotated, tucking this portion of the conductor under the retaining head to tighten the loop about a shank of the tie-down bolt. The difference in heights required to provide such a relationship depends, in part, on the engagement of the off-axis post with the retaining head of the tie-down bolt, but should typically not be more than about ¼". In some embodiments, as discussed below, the off-axis post is configured to engage a socket provided in the retaining head to stabilize the rotation of the tool, and in such cases it is typically effective for the difference in heights be less, such that $H_C-H_O$ can be in the range of about ⅛", depending on the depth to which the off-axis post inserts into the socket of the retaining head. It is also preferred for the central post exposed height $H_C$ to be limited to assure firm control of the winding action and avoid instability. For greatest control, it is preferred for the central post exposed height $H_C$ to be maintained no more than about 1", with a shorter height of about ½" being preferred.

When the difference in height of the posts is appropriately set and the radii of the posts are appropriately sized, their configuration allows the tool to be used to aid in wrapping the conductor loop about the shank of the tie-down bolt after the conductor has been inserted under the retaining head of the tie-down bolt. For such use, the off-axis post is placed on the retaining head, the retaining head terminating the tie-down bolt and having a head height $H_H$ and a head diameter D. When the tool is rotated about the off-axis post axis, then if $(H_C-H_O)$ is greater than the head height $H_H$ and the head diameter D is sufficiently restricted as to allow a portion of the central post to pass by the retaining head, then a portion of the central post resides below the level of the retaining head and thereby interacts with a loop tail portion of the looped conductor when the loop is placed around the shank of the tie down post. This interaction allows the central post to engage the loop tail and cause it to wrap beneath the retaining head as the central post is swung around the retaining head. When the end of the central post is configured such that it can be inserted between the loop tail and standing portion of a conductor loop that has been previously wound about a tie-down bolt, the tool can be operated in the reverse direction to use the central post to loosen the looped conductor to allow removal from the tie-down bolt.

For a conventional tie-down bolt retaining head having a socket such as a Phillips-head socket or a square-drive socket, the rotation of the tool about the off-axis post axis can be readily stabilized by providing the off-axis post with an off-axis terminal section having an off-axis terminal radius $R_{OT}$ selected to be cradled in the socket. For greater stability of the off-axis post in service, the profile of the off-axis post can be stepped, having $R_{OT}$ smaller than $R_O$.

Furthermore, the head diameter D of the retaining head of the tie-down bolt can be increased if the central post has a central post terminal section having a central post terminal radius $R_{CT}$ which is reduced from $R_C$. It can be readily appreciated that, in order for the central post terminal section to pass by the retaining head, the value of $2*(S-R_{CT})$ must be slightly greater than the head diameter D. Thus, having $R_{CT}$ small will facilitate the use of the tool with a tie-down bolt having a larger head diameter D. However, reducing the diameter of the central post over its entire exposed height such that $R_C$ is equal to or only slightly greater than $R_{CT}$ has its drawbacks; if the full exposed height of the central post is so reduced, the radius about which the conductor is bent to form the initial U-shape may be too small relative to the shank of the tie-down bolt, making the resulting loop difficult or impossible to engage with the tie-down bolt without further bending. Thus, a stepped central post where $R_{CT}$ is smaller than $R_C$ provides the dual benefit of accommodating larger tie-down bolt retaining heads while allowing a broader spacing for the U-shaped portion of the loop.

The utility of the tool can be further enhanced for a tool in the situation where the central post is longer than the off-axis post by providing a driver for tightening the retaining head of the tie-down bolt. This can be readily be done when the driver is a screwdriver formed on the central post terminal section. This allows a single tool to perform all operations associated with securing a stripped conductor to a tie-down bolt. If a driver such as a Phillips-head screwdriver (such as taught in U.S. Pat. No. 2,046,837) or a square-drive screwdriver (such as taught in U.S. Pat. RE6,729) is employed, care must be taken so that the grip is coupled to the central post in such a manner that the coupling can support the torque loads experienced in normal service. As noted above, the central post can be held in a socket that forms part the first end section of the grip, and such a mounting scheme is particularly useful when the central post terminal section is provided with a Phillips-head or square-drive screwdriver; such mounting allows the central post to be replaced if worn or damaged, and allows the user to replace the central post with a different screwdriver bit to allow using the tool as a conventional interchangeable-bit screwdriver. Further utility can be provided when the grip is hollow and has a second end section that is provided with a removable cap that allows access to the interior of the grip, allowing additional screwdriver bits to be stored within the grip. Such a cap could incorporate an auxiliary socket to allow a screwdriver bit to be mounted into the cap, such as to allow the user ready access to a slotted screwdriver bit while retaining the central post installed in the first end section.

When one or both posts are insertable into the grip, there is a means for retaining the post in the grip. This means can be any of a variety of those classically used for retaining interchangeable bits. One preferred embodiment is to use a ferromagnetic post and a magnet embedded in the grip.

BRIEF DESCRIPTION OF THE FIGURES

FIG. 2 illustrates the tool and the conductor when a stripped end of the conductor has been passed between the two posts and rests on the grip terminal surface with a free end of the conductor positioned at a first index mark. The separation between the posts is selected such that, if an insulated portion of the conductor is held and the tool is rotated, the conductor bends about the central post of the tool to form a loop, this loop having a tail of proper size for installing the loop about the shank of a tie-down bolt. Minor images of the index marks are provided to facilitate either right-handed or left-handed use of the tool.

FIG. 3 illustrates the tool and the conductor after the tool has been rotated in a first direction to bend the conductor. The free end of the conductor is maintained in place during the bending process by engagement against the off-axis post, allowing an intermediate portion of the conductor to bend about the central post to form a U-shaped loop. When the tool has been rotated to form the conductor into the desired U-shape, this status is indicated by the shank portion of the loop passing over a second index mark.

FIG. 4 illustrates the tool and conductor shown in FIGS. 2 and 3 when the tool is being rotated in the opposite direction to bring a shank portion of the loop against the other side of the off-axis post. Since the tool is rotated about its grip axis on which the central post resides, off-axis forces are avoided and the U-shaped loop remains in contact with the central post during rotation.

FIG. 5 illustrates the tool and conductor shown in FIGS. 2-4 when the tool has been rotated in the opposite direction so as to cause the shank portion of the loop to bend about the off-axis post, thereby changing the U-shaped loop into a "?"-shaped loop to facilitate placement under a retaining head of a tie-down bolt. While the proper degree of bending could be determined visually when the remaining portion of the conductor is directed so as to intersect the grip axis, greater uniformity can be provided by aligning the remaining portion of the conductor with a third index mark on the grip terminal surface.

DETAILED DESCRIPTION OF THE PREFERRED EMBODIMENTS

Figure 1:
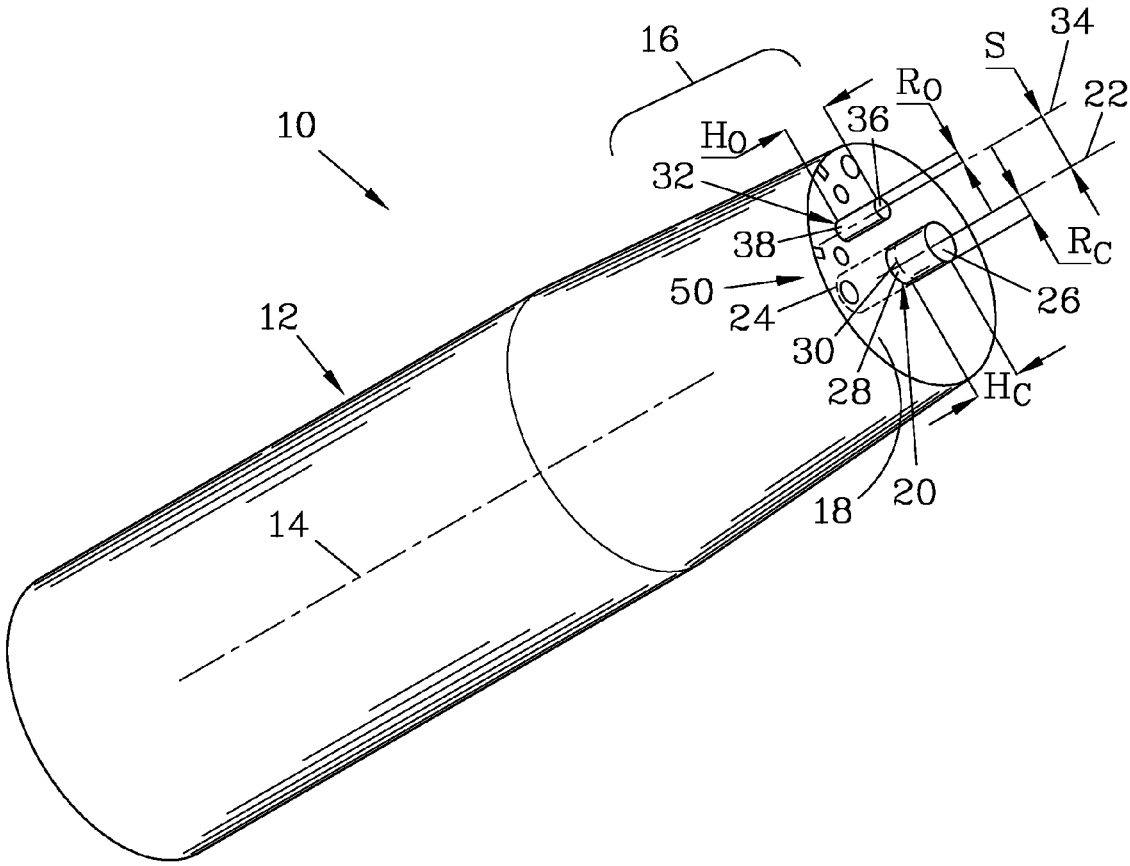
FIG. 1 is an isometric view showing one embodiment of a loop-forming tool of the present invention. The tool has a grip terminating in a grip terminal surface from which two exposed sections of posts extend, a central post that is aligned with a grip axis and an off-axis post that is parallel to and spaced apart from the grip axis. The central post has a greater radius than the off-axis post to facilitate forming a "?"-shaped loop in a conductor, as illustrated in FIGS. 2-5. The grip terminal surface is provided with index marks to facilitate the formation of loops having a uniform size and shape so that they can be readily attached to a tie-down bolt.

FIG. 1 is an isometric view showing a conductor loop-forming tool 10 of the present invention. The conductor loop-forming tool 10 has a grip 12 having a longitudinal grip axis 14 and terminating in a first end section 16 which has a substantially planar grip terminal surface 18. A central post 20 is provided, which has a central post axis 22 which is substantially aligned with the grip axis 14. The central post 20 has a central post embedded section 24 that is embedded in the first end section 16 of the grip 12. The central post 20 terminates in a central post free end 26 which is spaced apart from the grip terminal surface 18 to provide a central post exposed section 28 having a central post exposed height $H_C$. The central post exposed section 28 of this embodiment is cylindrical, having a central post radius $R_C$ which provides a line of contact 30 about which a conductor is bent to form a loop. This line of contact 30, in combination with contact with the grip terminal surface 18, provides a bending cradle for bending the conductor.

The conductor loop-forming tool 10 also has an off-axis post 32 having an off-axis post axis 34 that is parallel to the central post axis 22. The off-axis post 32 is again partially embedded in the first end section 16 of the grip 12 and terminates in an off-axis post free end 36 that is spaced apart from the grip terminal surface 18, leaving an off-axis post exposed section 38 having an off-axis post exposed section height $H_O$ which, in this embodiment, is the same as the central post exposed section height $H_C$. In this embodiment, the off-axis post exposed section 38 is cylindrical, providing an off-axis post radius $R_O$.

The central post axis 22 and the off-axis post axis 34 are spaced apart at separation S so as to provide a separation sufficient not only to allow a conductor 40 (shown in FIGS. 2-5 and 7) to be passed between the central post 20 and the off-axis post 32, but also of sufficient separation to create a reasonable bending moment so that the conductor 40 can be easily bent around the central post 20. Also, the posts (20, 32) need to be sufficiently close to limit the elastic deformation in the conductor 40 between the posts (20, 32) to assure that the conductor 40 can be plastically deformed to form a U-shape by the off-axis post 32 as the tool 10 is rotated about the grip axis 14. In one example of a loop-forming tool that has been found effective for use forming loops in both 12 gauge and 14 gauge conductors such that the loops are suitable in size and shape for attachment to conventional tie-down bolts, the central post was formed with the contact radius $R_C$ measuring about 3/32" and the off-axis post was formed with the radius $R_O$ measuring about 3/64". In this example, the posts were separated by a separation S of about 15/64".

Figure 2:
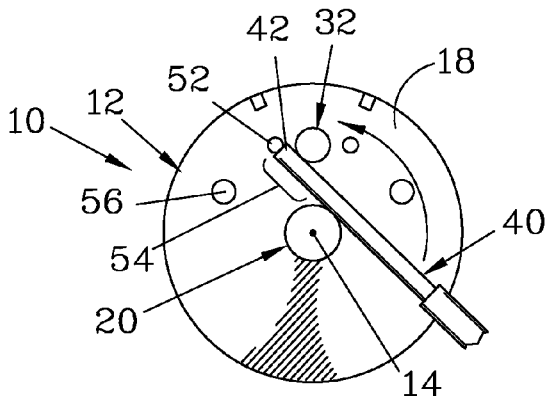
FIGS. 2-5 illustrate the loop-forming tool shown in FIG. 1 when used to form a "?"-shaped loop in a conductor, to provide a loop having a uniform size and shape shown in FIG. 7.

FIGS. 2-5 show the bending of the conductor 40 by the conductor loop-forming tool 10. For controlled bending to occur, it is necessary that, before bending, a free end 42 of the conductor 40 be positioned with respect to the off-axis post 32 such that the conductor 40 remains engaged with the off-axis post 32 as the tool 10 is rotated, allowing the posts (20, 32) and the grip terminal surface 18 to serve as a bending cradle for the conductor 40. Such a position for placing the conductor 40 onto the grip terminal surface 18 is illustrated in FIG. 2.

Figure 3:
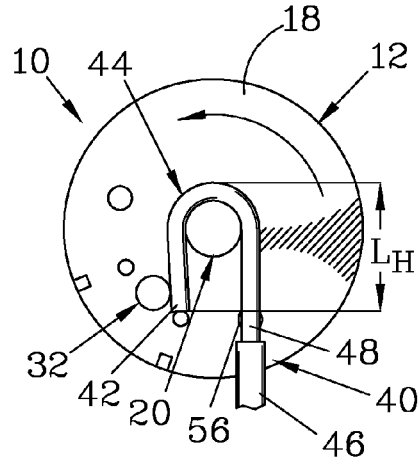
Figure 4:
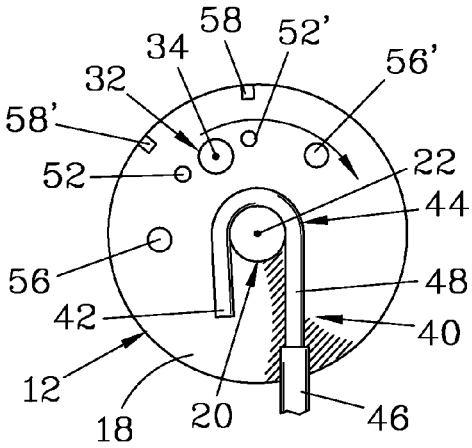
Figure 5:
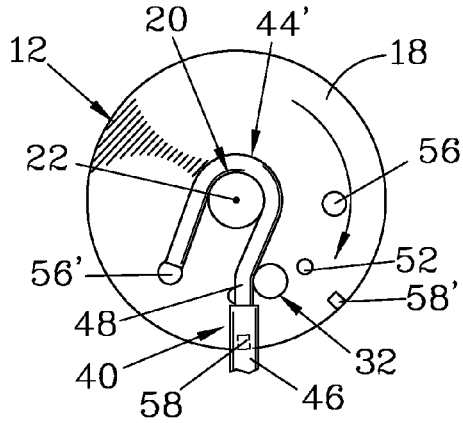
Figure 7:
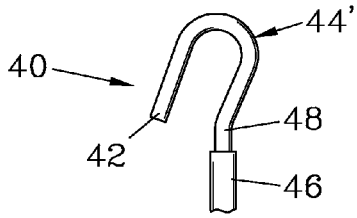
FIG. 7 illustrates the resulting "?"-shaped loop or hook formed in the conductor by the action of the loop-forming tool as indicated in FIGS. 2-6. The "?"-shape makes the loop easier to insert about the shank of a tie-down bolt compared to a U-shaped hook.

As the grip 12 is rotated about the grip axis 14, the force exerted by the off-axis post 32 causes the conductor 40 to deform to a U-shaped loop 44 as is illustrated in FIG. 3, where the conductor 40 is constrained by both posts (20, 32) as well as by the hand of a user holding an insulated portion 46 of the conductor 40. The loop 44 remains in contact with the central post 20 when the direction of rotation of the tool 10 is reversed, as indicated in FIGS. 4 and 5. This reverse rotation brings a shank portion 48 of the loop 44 (the portion on the opposite side of the bend from the free end 42 and terminating at the insulated portion 46) into contact with the off-axis post 32, causing it to introduce a reverse bend that changes the U-shaped loop 44 to a "?"-shaped hook 44' as is illustrated in FIGS. 5 and 7. This "?"-shaped hook 44' is highly desirable, since it facilitates inserting the hook 44' under a retaining head of a tie-down bolt (see FIGS. 8 and 9) before the conductor 40 is secured. In certain situations where the accessability of the tie-down bolt is limited, the "?"-shaped hook 44' can be particularly helpful. It is preferable in many situations to have the radii of the posts (20, 32) selected such that $R_O$ is less than $R_C$ to provide a smaller bending radius such that the conductor 40 plastically deforms with less rotation when bending against the off-axis post 32, thereby assuring an offset in the U-shaped structure to form a "?"-shape. It should be noted that the insulation on the conductor 40 should be stripped off a sufficient distance that the insulated portion 46 does not engage the off-axis post 32 when forming the "?"-shaped hook 44'.

The loop-forming tool 10 is also provided with index marks 50 (labeled collectively in FIG. 1) which provide means for assuring consistency of the loops formed by the tool 10 to assist a user in generating loops of uniform size and shape. These index marks 50 are provided on the grip terminal surface 18, on which the conductor 40 rests (as illustrated in FIGS. 2-5) when it is being plastically deformed to form a loop. To assure a consistent size of the hooks formed by the tool 10, a first index mark 52 is provided to mark a consistent extension 54 of the conductor 40 beyond its contact point on the central post 20. This will assure that the U-shaped loop 44 has a consistent hook length $L_H$ (as illustrated in FIG. 3) and serves as a means for assuring a consistent loop size, so that the resulting loop 44 has a portion that extends sufficiently to be wrapped about a tie-down bolt, as discussed in greater detail below. For use with typical tie-down bolts on commercially available electrical system components, it has been found effective for the position of the first index mark relative to the posts to be set such as to result in the hook length $L_H$ being about 7/16" for 12 gauge conductors and about 3/8" for 14 gauge conductors.

A second index mark 56 aids the user in determining how far to rotate the grip 12 to provide the U-shaped loop 44. The second index mark 56 is positioned such that it will reside under the shank portion 48 of loop 44 when the conductor 40 has been bent sufficient to create the U-shaped hook 44, as illustrated in FIG. 3, thereby providing a means for assuring a consistent shape of the loop. Thereafter, the loop-forming tool 10 can be rotated in the opposite direction until the shank portion 48 engages the off-axis post 32 and bends thereabout until the insulated portion 46 of the conductor 40 is oriented so as to substantially intersect the central post axis 22, as shown in FIG. 5. As an alternative to visually determining when the desired reverse bend has been achieved, a third index mark 58 can be provided to indicate when such a bend has been achieved, and this might be coincident with one of the other marks. This will provide a means for assuring a constant cant of the hook with respect to the insulated portion 46 of the conductor 40 to assure a consistent shape for the "?"-shaped hook 44'. To allow the unit to be used either right-handed or left-handed, mirrored index marks 52', 56', and 58' can be provided that are reflected across the plane of the two post axes (22, 34).

Figure 6:
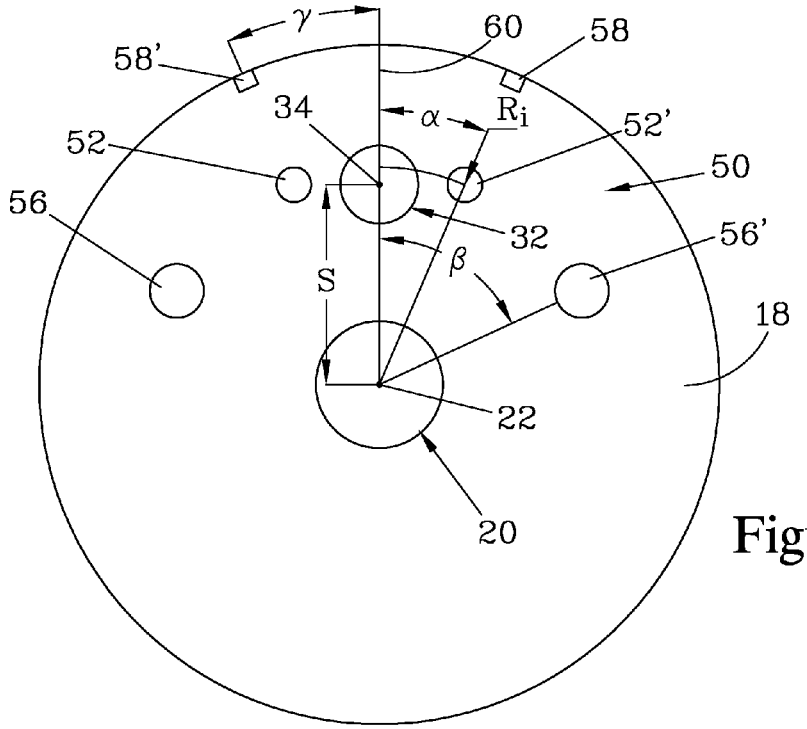
FIG. 6 better illustrates the placement of the index marks on the grip terminal surface of the embodiment shown in FIGS. 1-5.

FIG. 6 illustrates one example of the positioning of the index marks 50 on the grip terminal surface 18. For the dimensions and separation of the posts (20, 32) set forth above, and for use with both 12 gauge and 14 gauge conductors, it has been found effective for the first index marks (52, 52') to be positioned at an angle $\alpha$ of about 30° with respect to a reference plane 60 defined by the post axes (22, 34), and positioned at a first index mark radius $R_i$ of slightly greater than the separation S, measuring about ¼", from the central post axis 22. The second index marks (56, 56') were positioned at an angle $\beta$ of about 65° with respect to the reference plane 60. When the third index marks (58, 58') were provided, they were positioned at an angle $\gamma$ of about 30° with respect to the reference plane 60; since this angle is the same as that of the first index marks (52, 52'), the third index marks (58, 58') could be omitted and the first index marks (52, 52') employed to determine when the appropriate reverse bend has been achieved.

Figure 8:
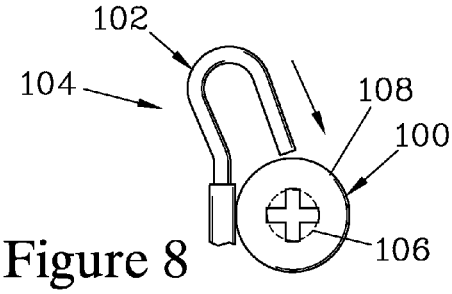
FIG. 8 illustrates a "?"-shaped conductor loop formed by a process such as shown in FIGS. 2-5, when inserted under the retaining head of a tie-down bolt to secure the loop to a tie-down substrate. The "?"-shape of the conductor loop has been found easier to insert compared to a U-shaped loop, particularly when access to the tie-down bolt is limited.
Figure 9:
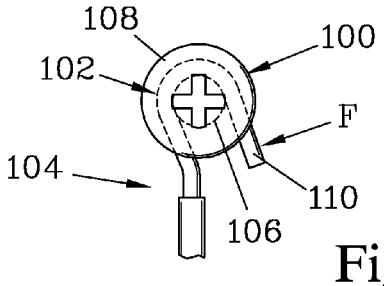
FIG. 9 shows the conductor loop and the tie-down bolt shown in FIG. 8 when the loop has been inserted under the retaining head of the tie-down bolt, so as to partially encircle a shank of the tie-down bolt. A loop tail, which terminates in a free end of the conductor, protrudes beyond the retaining head, and should be tucked under the retaining head by applying a force as indicated to bend the tail about the shank of the tie-down bolt.
Figure 10:
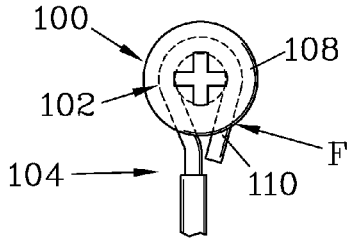
FIG. 10 shows the conductor loop and tie-down bolt shown in FIGS. 8 and 9 when the loop tail has been bent about the shank of the tie-down bolt by applying a force to the loop tail. In this position, the loop tail resides substantially under the retaining head, and the tie-down bolt can be subsequently tightened to secure the conductor to the tie-down substrate into which the tie-down bolt is threaded.

The conductor loop discussed above is created to terminate a conductor so that it can be affixed to a tie down bolt 100 shown in FIGS. 8-10. The tie-down bolt 100 is sized to engage a conductor loop 102 of a conductor 104 such that the loop 102 will pass around a bolt shank 106 and reside under a retaining head 108 of the tie down bolt 100. This position is illustrated in FIG. 9. When the conductor loop 102 is brought into contact with the bolt shank 106, a loop tail 110 extends beyond the retaining head 108. This loop tail 110 should be substantially tucked under the retaining head 108, as shown in FIG. 10, prior to tightening the bolt 100 so as to grip the conductor loop 102. This can be done by applying a force F using a variety of instruments, such as a screwdriver or needle-nosed pliers.

Figure 11:
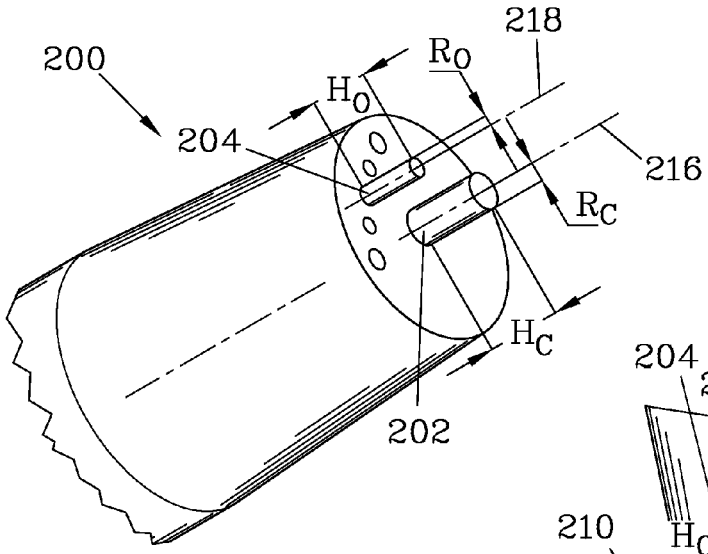
FIG. 11 is an isometric view illustrating another embodiment of the present invention, a loop-forming and winding tool that can be used to form conductor loops in the same manner as the loop-forming tool shown in FIGS. 1-6, but which can also be used to apply a force to tuck a loop tail under a retaining head of a tie-down bolt to facilitate the securing process shown in FIGS. 8-10. The loop-forming and winding tool has a central post having a greater exposed height extending from the grip terminal surface than that of the off-axis post. The difference in height is selected such that, if the off-axis post is placed on the retaining head of the tie-down bolt, the central post extends below the level of the retaining head, allowing the central post to engage the loop tail of the conductor and apply a force to bend it around a shank of the tie-down bolt as the tool is rotated about the off-axis post.

While the loop-forming tool 10 which is illustrated in FIG. 1 will not provide the auxiliary function of tucking a loop tail under the retaining head of a tie-down bolt, a loop-forming and winding tool 200 illustrated in FIG. 11 can perform this function, as well as all of the loop forming functions of the loop-forming tool 10, since it includes the structural elements of the loop-forming tool 10. The loop-forming and winding tool 200 differs from the loop-forming tool 10 in the details of its central post 202 and its off-axis post 204. While the discussion below will be discussed in terms of the combined tool, it should be appreciated the additional features of the tool have befit even if the tool does not have the means for assuring consistency of the loop (e.g., the index marks) as part of the structure of the tool.

Figure 12:
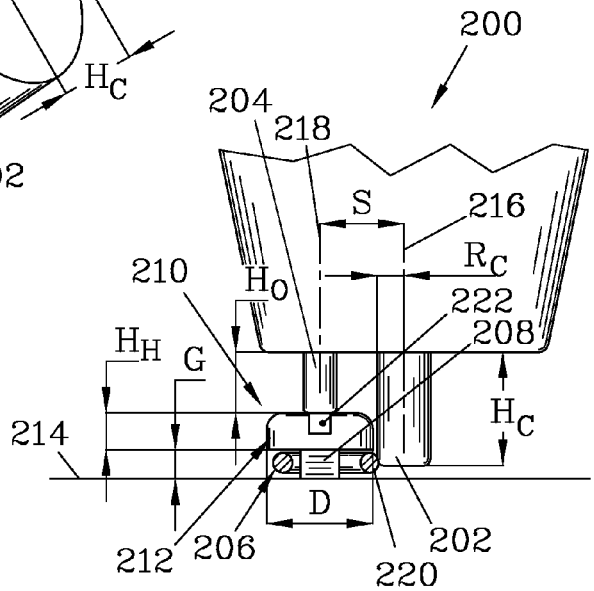
FIG. 12 is a side view showing the loop-forming and winding tool shown in FIG. 11 when the off-axis post has been placed onto the retaining head of a tie-down bolt, and the central post is positioned to engage the conductor.

Again, the central post 202 has a central post radius $R_C$ and the off-axis post 204 has an off-axis post radius $R_O$. In this embodiment, the off-axis post 204 has an exposed height $H_O$ that is less than an exposed height $H_C$ of the central post 202. As shown in FIG. 12, this difference in height is provided to allow the tool 200 to aid in wrapping a conductor loop 206 about a shank 208 of a tie down bolt 210 when the conductor loop 206 is positioned thereabout. The tie down bolt 210 has a retaining head 212 with a head height $H_H$ and which is separated from a tie-down substrate 214 by a gap having a depth G. In this case, the difference in heights ($H_C$–$H_O$) must be greater than the head height $H_H$ and less than or equal to ($H_H$+G). A second condition which must be met for the tool 200 to serve as a winder is that the central post 202 have a central post axis 216 that is spaced apart from an off-axis post axis 218 by a separation S where $2*(S-R_C)$ is slightly greater than the head diameter D. If these conditions are met and the tool 200 is centered above the retaining head 212, as shown in FIG. 12, then rotating the conductor loop-forming and winding tool 200 about the off-axis post axis 218 causes the central post 202 to rotate around the diameter of the retaining head 212, engaging a loop tail 220 of the loop 206 to force it under the retaining head 212, in the manner shown in FIGS. 9 and 10 for the tie-down bolt 100 and the loop 102. Similarly, when the central post 202 is configured to be inserted between the loop tail 220 and the remainder of the loop 206, it could be swung in the opposite direction to loosen a conductor that is to be removed from a tie-down bolt. To assure stable control of the winding operation, the central post exposed height $H_C$ can be limited. For greatest control, the central post exposed height $H_C$ should be maintained not more than about 1", and more preferably about ½".

Figure 13:
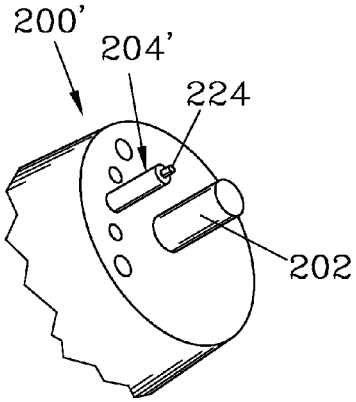
FIG. 13 is a partial view of an alternative loop-forming and winding tool, which is similar to that shown in FIG. 11, but which has an off-axis post that is provided with a protrusion that can engage a recess (such as a slot or Phillips-head socket) in the retaining head of the tie-down bolt so as to stabilize the rotation of the tool about the off-axis post.
Figure 14:
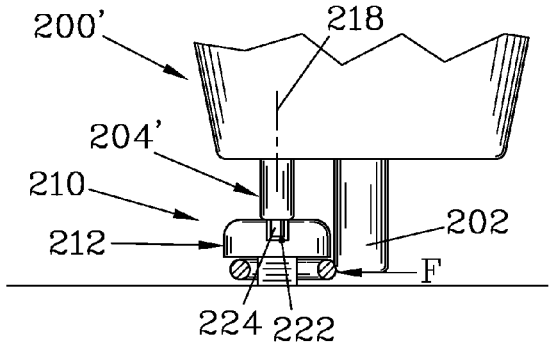
FIG. 14 is a side view of the tool shown in FIG. 13, with the protrusion on the off-axis post engaging a slot in the retaining head of the tie-down bolt to stabilize the rotation of the tool. Rotation about the off-axis post causes the central post to engage the conductor and apply a force to bend the loop tail under the retaining head of the tie-down bolt.

Generally, the retaining head 212 of the bolt 210 has an indentation 222 in its center; this indentation may be a slot for inserting a blade-type screwdriver or, alternatively, may be a socket into which a Phillips-head screwdriver or other driver head such as a square driver can be inserted. If such is present, then it is preferred that the off-axis post 204' be provided with a protrusion 224 such as shown in FIGS. 13 and 14, the protrusion 224 being configured such that it will fit into the indentation 222 to stabilize the tool 200' as it is being rotated about the off-axis post axis 218, as shown in FIG. 14.

Figure 15:
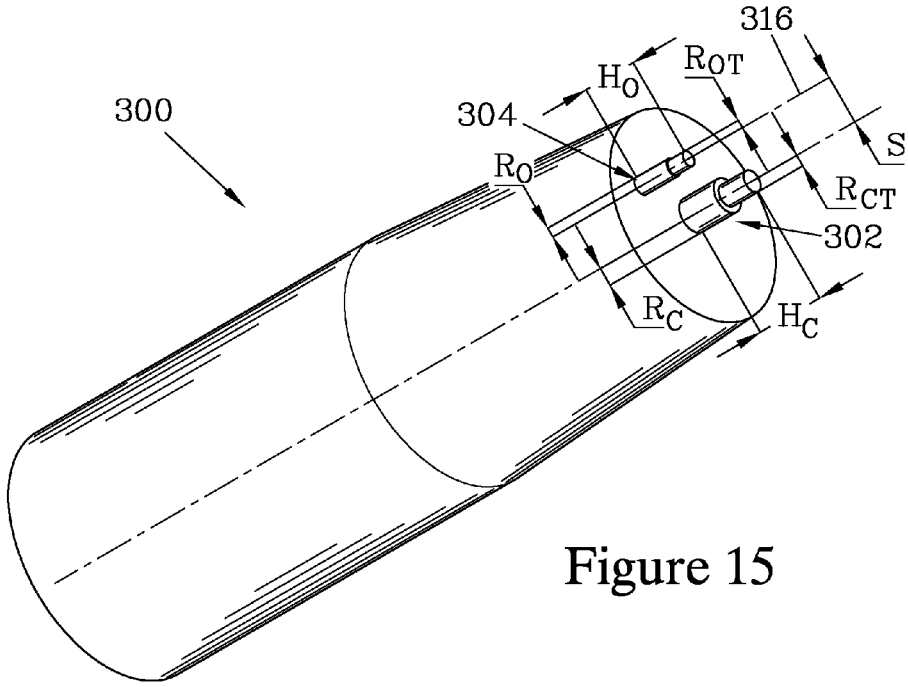
FIG. 15 is an isometric view of a loop-forming and winding tool which is designed to accommodate tie-down bolts having a larger diameter retaining head than can be accommodated by the tools shown in FIGS. 11 and 13. The central post of this embodiment has a central post terminating section with a reduced radius so as to clear a larger diameter retaining head. In this embodiment, the off-axis post is also provided with a reduced radius off-axis post terminating section, which is sized to be inserted into a standard Phillips-head socket in the retaining head of the tie-down bolt so as to stabilize rotation of the tool about the off-axis post when winding a conductor loop about the tie-down bolt.
Figure 16:
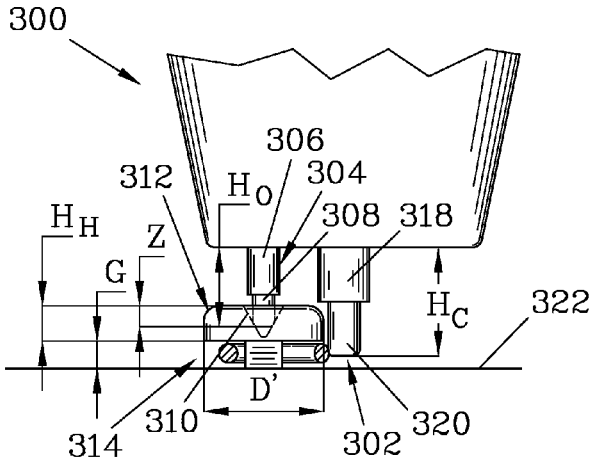
FIG. 16 is a side view showing the tool shown in FIG. 15 when employed to tuck a loop tail of a conductor loop under the retaining head of a tie-down bolt. The off-axis post terminating section is inserted into the socket in the retaining head, while the central post terminating section clears and extends below the retaining head to engage the conductor loop.
Figure 17:
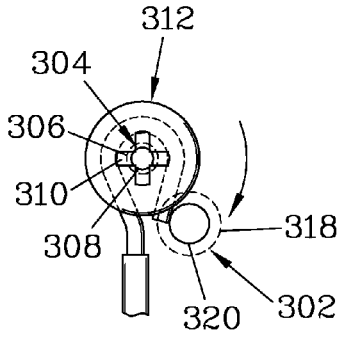
FIG. 17 is a view looking down the shafts of the tie down bolt, and the conductor loop shown in FIG. 16. Rotation of the tool about the off-axis post brings the central post terminating section into forcible engagement with the loop tail of the conductor loop, pushing it under the retaining head of the tie-down bolt.

FIGS. 15 and 16 illustrate another embodiment of a loop-forming and winding tool 300, wherein not only is a central post exposed height $H_C$ of a central post 302 greater than an off-axis post exposed height $H_O$ of an off-axis post 304, but the off-axis post 304 has an exposed base section 306 (labeled in FIG. 16) having a radius $R_O$ and an off-axis post terminating section 308 having an off-axis terminal radius $R_{OT}$ that is reduced such that it can be cradled in a Phillips-head socket 310 in a retaining head 312 of a tie down bolt 314, as shown in FIGS. 16 and 17. Having the off-axis post 304 so configured provides a benefit in that, for a conventional retaining head 312 having the Phillips-head socket 310, the rotation of the tool 300 about an off-axis post axis 316 can be readily stabilized by engagement of this off-axis post terminating section 308 with the socket 310. In fact, while the larger off-axis radius $R_O$ as illustrated would allow the off-axis post 304 to be cradled, the reduced cross-section of the off-axis post terminating section 308 allows it to be seated deeper in the Phillips-head socket 310 for greater stability, defining an effective depth Z for the Phillips-head socket 310.

If the loop-forming and winding tool 300 illustrated in FIGS. 15 and 16 is further configured to provide the central post 302 with a base section 318 having a radius $R_C$ and a terminal section 320 having a radius $R_{CT}$, where $R_{CT}$ is less than $R_C$ (as better shown in FIG. 16), this condition permits the retaining head 312 to have a diameter D' which is larger than the diameter D accommodated by the loop-forming and winding tool 200, while still maintaining the same axis separation S (shown in FIG. 15) and the same radius $R_C$ as employed by the loop-forming and winding tool 200. In this embodiment, the difference between $H_C$ and $H_O$ must be greater than a head height $H_H$ minus the effective depth Z of the socket 310, and less than the sum of ($H_H$–Z) plus the gap depth G between the retaining head 312 and a tie-down substrate 322 to allow the tool 300 to be employed while extending substantially normal to the tie-down substrate 322. For such an embodiment designed for use with conventional electrical system components, a difference in height ($H_C$–$H_O$) of between about 7/64" and 9/64" has been found particularly effective.

FIG. 17 is a view looking down the shafts (302, 304) of the tool 300 and illustrates the terminal section 320 tucking the conductor under the retaining head 312 when the tool 300 is rotated about the off-axis post 304 brings the terminal end section 320 of the central post 302 into forcible contact the conductor so that it bends under the retaining head 312.

Figure 18:
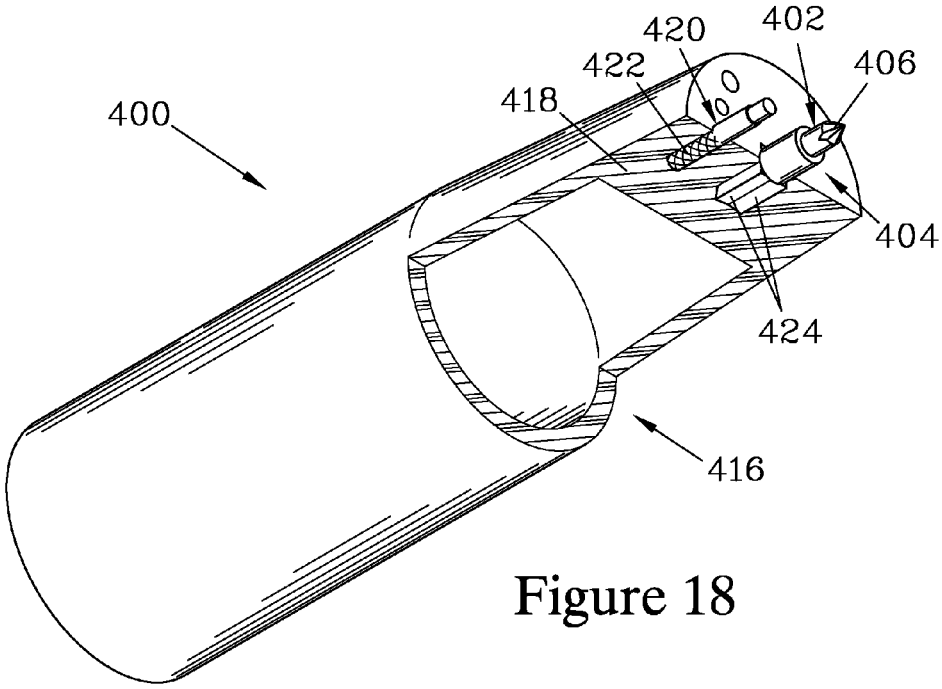
FIG. 18 is a partially-sectioned isometric view of another loop-forming and winding tool, which can also provide a further function of tightening a tie-down bolt having a Phillips-head socket. The central post terminating section of this embodiment is formed with a Phillips-head screwdriver. The sectioned portion of the grip shows how mounting sections of the posts are embedded in a solid first end section of the grip. The off-axis post has a knurled portion to retain it in the grip, while the central post has an array of radiating fins that are embedded in the grip. The fins provide resistance to torques created when the central post terminating section is employed as a screwdriver. The remainder of the grip is hollow to reduce weight and cost of fabrication.
Figure 19:
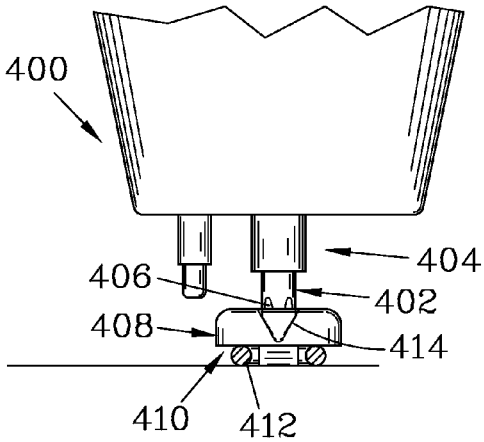
FIG. 19 is a side view showing the tool shown in FIG. 18 when the central post terminating section is employed as a screwdriver to tighten a tie-down bolt about which a conductor loop has been wound.

FIG. 18 illustrates another embodiment of a conductor loop-forming and winding tool 400 that differs from the conductor loop-forming and winding tool 300 in the details of a central post terminal section 402 of a central post 404. In this embodiment, the central post terminal section 402 is formed to serve as a screwdriver; in the embodiment illustrated, a Phillips-head screwdriver 406 serves as the terminal end of the central post terminal section 402, so that the conductor loop-forming and winding tool 400 can be used to tighten a retaining head 408 of a tie-down bolt 410 to secure a conductor loop 412 when the screwdriver 406 is engaged in a socket 414 of the retaining head 408, as illustrated in FIG. 19.

Figure 20:
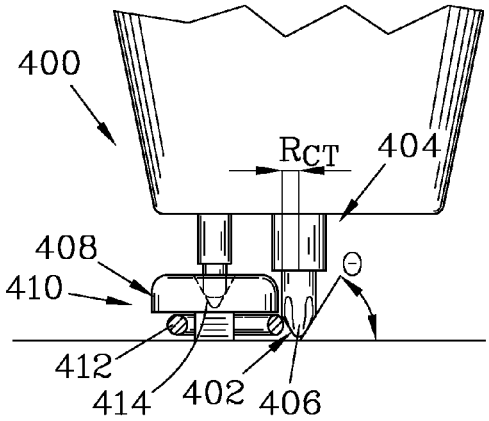
FIG. 20 is a side view showing the tool, the tie-down bolt, and the conductor loop shown in FIG. 19 when a reduced-diameter off-axis post terminating section has been inserted into a Phillips-head socket on the retaining head of the tie-down bolt, thereby providing a fulcrum about which the tool can be rotated. As the tool is rotated about the off-axis post, the central post terminating section is swung into engagement with a loop tail of the conductor loop to force it under the retaining head of the tie-down bolt.

FIG. 20 shows the tool 400 when employed to tuck the conductor loop 412 under the retaining head 408. When the central post terminal section 402 is provided with the screwdriver 406, the tucking function is most effective when the angle θ of the screwdriver 406 is relatively large so that the conductor 412 engages the terminal section 402 at a location where the cross section remains substantially at a central post terminal radius $R_{CT}$. The Phillips head screwdriver 406 also provides the central post terminal section 402 with a relatively small cross section at its tip, facilitating insertion of the central post terminal section 402 between portions of the conductor loop 412 when it is desired to loosen the conductor loop 412.

In FIG. 18, a portion of a grip 416 of the tool 400 is shown in section. In this embodiment, the grip 416 has a solid first end section 418, and the remainder of the grip 416 is hollow. The sectioning of the grip 416 reveals the structure of the surfaces of the embedded portions of the central post 404 and an off-axis post 420. The embedded portion of the off-axis post 420 has a knurled surface 422 which is employed to secure the off-axis post 420 in the grip 416. Since the central post 404 is subject to greater torque loads when the screwdriver 406 is employed, radial fins 424 are provided on the central post 404. The use of the fins 424 has a secondary benefit in that they can be driven into a passage in the grip 416 to facilitate fabrication.

While a central post which incorporates a screwdriver can be permanently embedded in the first end section of the grip to facilitate fabrication, greater versatility for the tool of the present invention can be provided by making the central post an interchangeable part, allowing it to be replaced with an alternative screwdriver bit. In some cases, a conventional screwdriver bit can be employed to provide the central post, although this may preclude use of the tool to perform winding operations.

Figure 21:
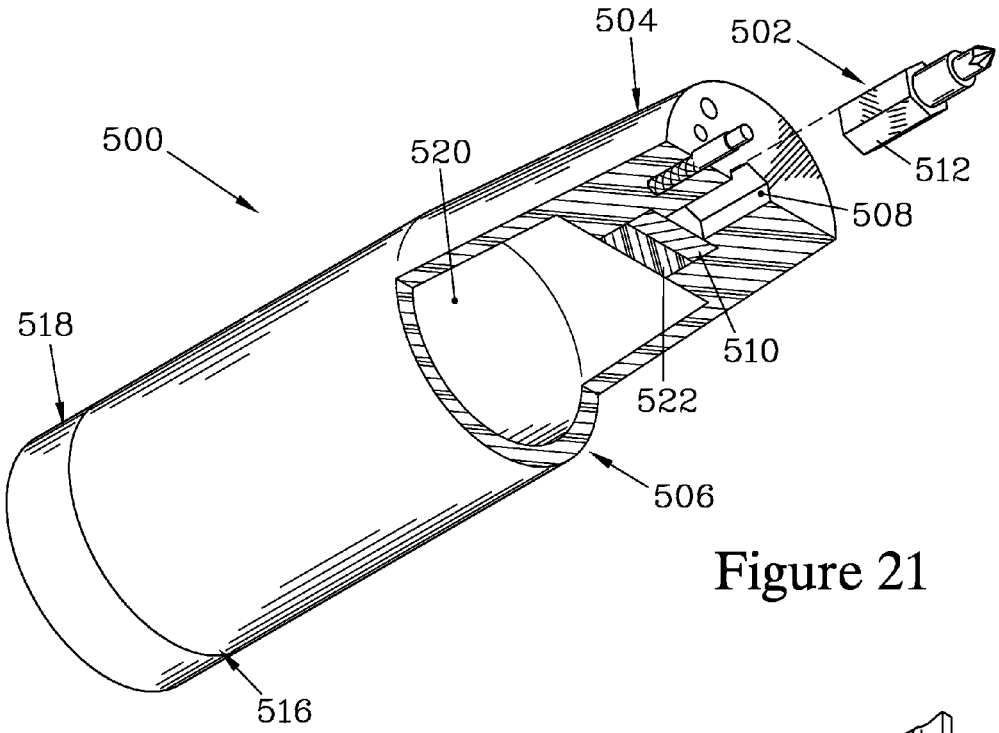
FIG. 21 is an isometric view showing a loop-forming and winding tool similar to that shown in FIG. 18, but with additional features to enhance the versatility of the tool. In this embodiment, the central post that is formed with a Phillips-head screwdriver is removably held in the first end section of the grip. The central post has a hexagonal central post embedded section that slidably engages a passage having a hexagonal cross section and terminating at a magnet that is embedded in the first end section of the handle. The grip of this embodiment is hollow, and has a second end section that terminates in a cap which can be removed to allow access to the interior of the grip, allowing additional screwdriver bits to be stored therein.
Figure 22:
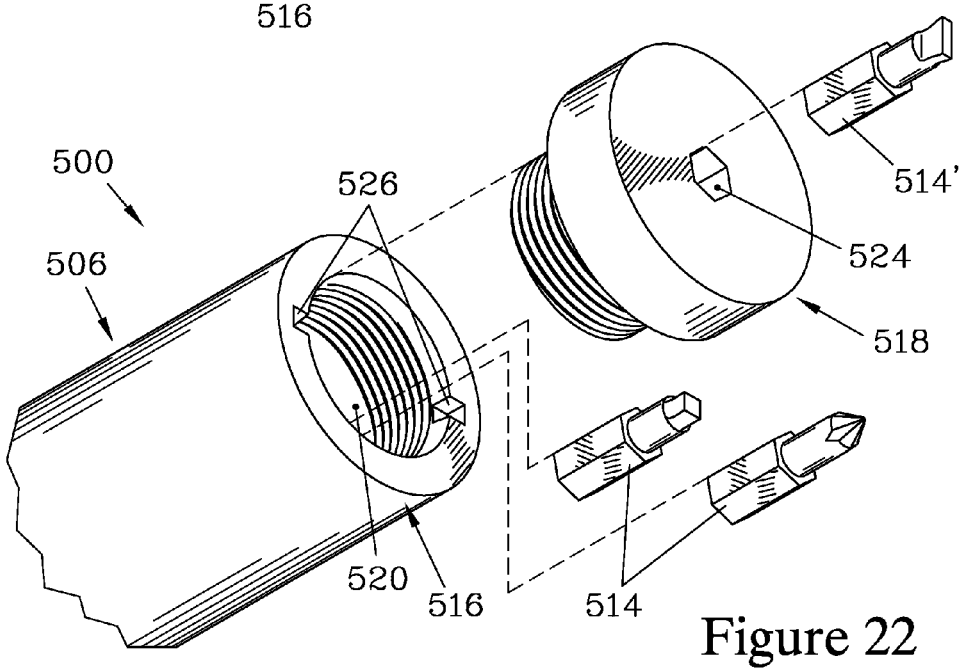
FIG. 22 is an isometric view of the second end section and cap of the embodiment shown in FIG. 21, when the cap has been removed from the second end section. The cap incorporates an auxiliary socket that allows a second screwdriver bit to be mounted ready for use.
Figure 23:
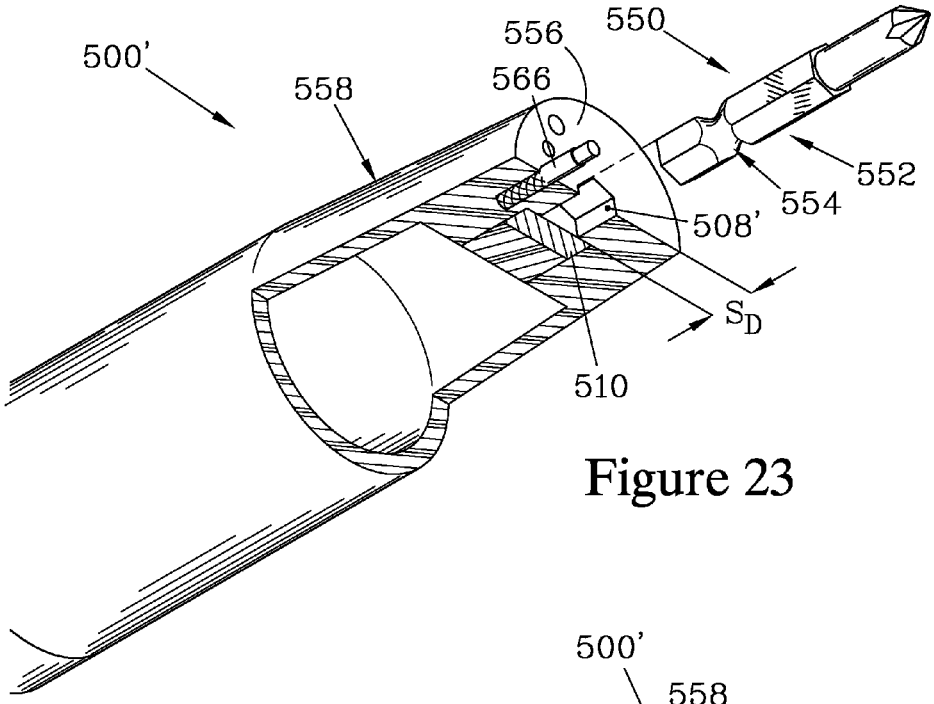
FIG. 23 is an isometric view of the embodiment that is similar to the embodiment of FIG. 21. This embodiment differs, in part, in that the central post has been replaced with a conventional screwdriver bit configured to be used in a socket driver or gripped by the jaws of a drill chuck. Thus, in this embodiment, the tool does not include a central post but rather a socket positioned in the first end section of the grip and configured to engage a conventional screwdriver and allow it to serve as a central post. The use of such bits, which come in various lengths, allows a user to tighten screws that are recessed below a surrounding surface. The screwdriver bit illustrated has a notch that provides a surface on which the conductor can be conveniently wound, forming a line of contact having a contact radius which is less than the radius of a circle circumscribed about the flat surfaces of the screwdriver bit.
Figure 24:
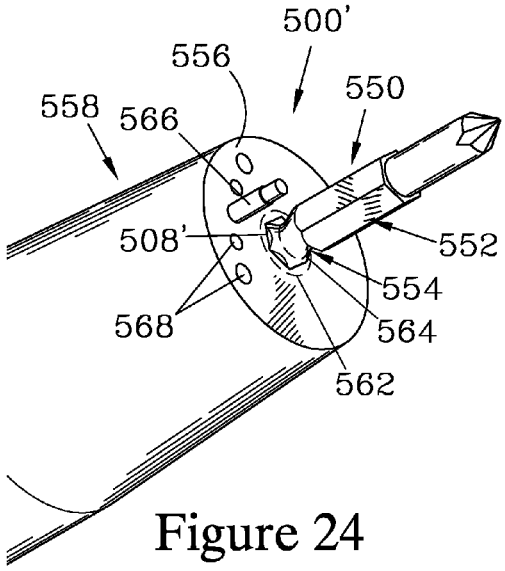
FIG. 24 illustrates the same tool when the screwdriver bit is mounted in the socket. The depth of the socket has been selected such that, in normal service, the notch resides in part above the substantially planar terminal surface and is positioned to serve as part of a cradle for bending the conductor. The notch has a radius at line of contact it makes with the conductor to provide an appropriate bending anvil for bending the conductor to assure that an appropriate diameter of the loop is obtained.

FIGS. 21 and 22 illustrate a conductor loop-forming and winding tool 500 which has a central post 502 that is removably held in a first end section 504 of a grip 506. The first end section 504 has a grip passage 508 that terminates at a magnet 510 which is embedded in the first end section 504 and closes one end of the grip passage 508 to form a socket. This magnet 510 serves as means for holding the central post 502 in position. It should be appreciated that other retaining means could be employed, such as a spring-loaded ring that engages a detent notch provided on the central post 502. The grip passage 508 has a hexagonal cross-section configured to slidably engage a central post embedded section 512 of the central post 502. This configuration allows the central post 502 to be slid in and out of the grip passage 508 but prevents rotation therein. The grip passage 508 in this embodiment is sized to accept the shank of a conventional ¼" hexagonal bit such as is conventionally employed for interchangeable-bit screwdrivers. Since the central post 502 is removably retained in the grip passage 508, it can be readily replaced if worn or damaged, and can be replaced with an alternative screwdriver bit 514 (shown in FIG. 22) to increase the versatility of the tool 500.

To store a number of the alternative bits 514 such as a blade driver bit or a square-drive bit so that alternate post designs can be tightened by the tool 500, the grip 506 is hollow and has a second end section 516 that is closed by a removable cap 518. In this embodiment, the cap 518 threadably engages the second end section 516 of the grip 506. The cap 518 is removed to allow access to an interior space 520 of the grip 506, thereby allowing the alternative bits 514 to be conveniently stored therein. When the magnet 510 is a rare earth magnet such as a neodymium magnet, it can provide a sufficiently great magnetic force to retain the alternative bits 514 within the interior space 520 until such time as they are shaken loose by the user, thereby preventing loss of the alternative bits 514 when the cap 518 is removed. In fact, the separation of the interior space 520 from the magnet 510 by a plug 522 may need to be adjusted so that the alternative bits stored in the interior space 520 can be readily removed by shaking. The cap 518 can be provided with a magnet (not shown) to cause the alternative bits 514 to be drawn out with the cap 518 when it is removed to provide greater ease of access to the alternative bits 514.

Further utility of the tool 500 can be provided when the cap 518 is provided with an auxiliary socket 524 that is configured to retain one of the alternative bits 514. This allows the user to mount a selected one of the alternative bits 514 ready for use. For example, the user can keep a slotted screwdriver bit 514' installed in the auxiliary socket 524 to facilitate removing switch plates, outlet plates and similar parts that are typically retained by slotted screws, while maintaining the central post 502 with its Phillips-head screwdriver ready for use on the other end of the tool 500.

The utility of the tool 500 can be further increased when the second end section 516 is provided with wing-engaging notches 526 that are exposed when the cap 518 is removed, the wing-engaging notches 526 being configured to engage the wings provided on conventional twist-on wire connectors to enable the user to readily apply torque to such a connector to ease installation of the connector onto twisted conductors.

While the embodiments discussed above employ either an embedded structure or a dedicated bit to provide the central post, the tool of the present invention need not in and of itself include the central post, but can be designed to cooperate with a commercially available screwdriver bit which serves as the central post. However, when such is done the resulting tool may lack some to the attributes of earlier discussed embodiments. FIGS. 23-28 illustrate a loop-forming tool 500' that is structurally very similar to the loop-forming and winding tool 500 shown in FIGS. 21 and 22, but which is designed to cooperate with a commercially available screwdriver bit 550 in order to provide a loop-forming tool having a function similar to that of the loop-forming tool 10 shown in FIGS. 1-6.

The tool 500' has a socket 508' that has a socket depth $S_D$ and which is sized to slidably accept a shank 552 of the screwdriver bit 550. The shank 552 has a circumferential notch 554 such as is commonly found on commercially available interchangeable screwdriver bits. Again, a magnet 510 is provided for retaining the shank 552 in the socket 508'. However, the socket depth $S_D$ of the socket 508' is chosen such that, when the shank 552 is fully inserted into the socket 508', the notch 554 is positioned so as to reside in close vicinity to a terminal grip surface 556 of a grip 558 of the tool 500'.

Figure 25:
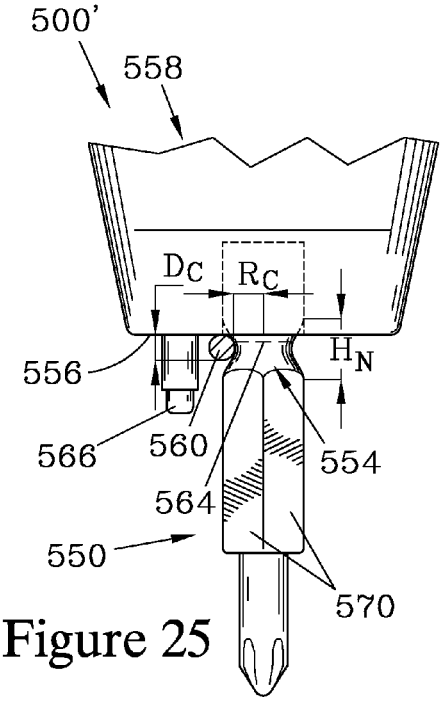
FIG. 25 is a side view of the tool and screwdriver bit shown in FIGS. 23 and 24, illustrating a line of contact on the screwdriver bit where it is contacted by a conductor being bent. As can be seen, when the tool is so configured it does not have the capacity to serve as tool for winding the conductor under the retaining head of a tie-down bolt.

When the notch 554 is so positioned, the notch 554 having a breadth $H_N$ which is significantly wider than the diameter $D_C$ of a conductor 560 being bent (as shown in the side view of FIG. 25), the notch 554 in combination with the terminal grip surface 556 forms a conductor bending cradle. This cradle provides support on two lines of contact as it promotes bending of the conductor 560. The terminal grip surface 556 supports the conductor 560 on a circular line of contact 562 (shown in FIG. 24), while a second line of contact 564 results where the notch 554 is contacted by the conductor 560 (as shown in FIG. 25), this second line of contact 564 defining a contact radius $R_C$ for bending the conductor 560. Configuring the socket 508' such that the notch 554 is so positioned relative to the terminal grip surface 556 allows the bit 550 to serve a function similar to that of the central post 20 of the tool 10 shown in FIGS. 1-6, serving in combination with an off-axis post 566 to bend the conductor 560 to form a "?"-shaped loop 560' (shown in FIG. 27) for attachment to a tie-down bolt. Index marks 568 are provided on the grip terminal surface 556 to aid the user in positioning the conductor 560 and bending it the proper distance around the lines of contact (562, 564) to assure consistency in the loop 560' so that it is formed with an appropriate size and shape to be installed onto a tie-down bolt.

Figure 26:
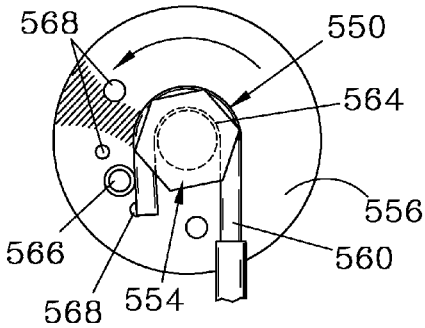
FIGS. 26 and 27 illustrate the embodiment illustrated in FIGS. 23-25 when used for forming a conductor into a "?" shaped hook by bending the conductor first around the notch in the screwdriver bit (as shown in FIG. 26) and subsequently against the off-axis post (as shown in FIG. 27). While this embodiment does not provide a winding capacity, it does provide the means for forming hooks having a consistent size and shape.
Figure 27:
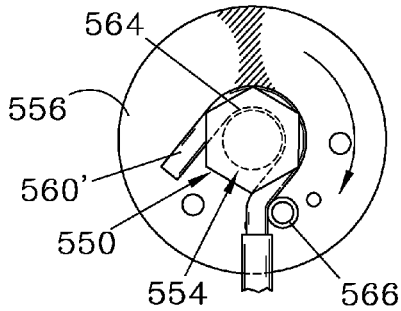
Figure 28:
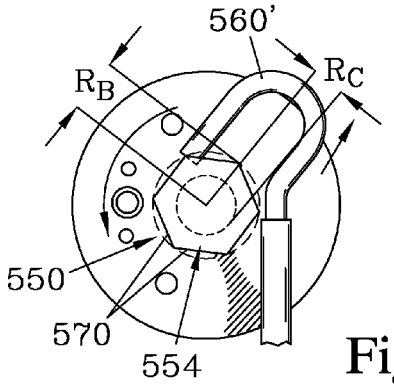
FIG. 28 illustrates the tool and conductor shown in FIGS. 26 and 27 when repositioned after the hook is formed so that the hook can be slid out of the notch and off the tool, after the conductor has been bent about a radius smaller than the radius of a circle circumscribing the flat surfaces of the screwdriver bit.

While the bending function of the present embodiment is similar to that of the earlier described tools, there are distinctions that result from having the bending being performed in the notch 554, as is illustrated in various stages in FIGS. 26 and 27. Having the loop 560' so formed in the notch 554 results in the loop 560' being incapable of being lifted off the bit 550, since the loop 560' resides, in part, in the notch 554 and is bent to the contact radius $R_C$ which is less than a bit radius $R_B$ of a circle (shown in FIG. 28) that circumscribes flat surfaces 570 of the bit 550. Thus, to remove the loop 560' from the notch 554, the user must reposition the loop 560' by rotating the tool 500' such that the loop 560 can be slid out of the notch 554, as is illustrated in FIG. 28.

Figure 29:
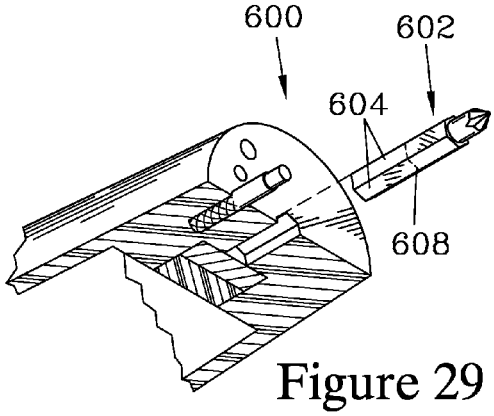
FIG. 29 illustrates a tool of the present invention where the central post has a hexagonal cross section; however, the flat surfaces are sufficiently short that they present an effectively circular cross-section for the bit, about which a conductor can be bent.
Figure 30:
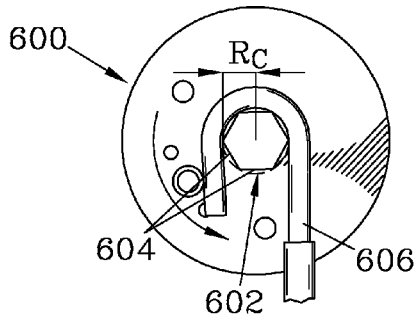
FIG. 30 illustrates the tool of FIG. 29 when used to bend a "U" shaped loop in a conductor.

FIGS. 29 and 30 illustrate a tool 600 having a central post formed by a removable screwdriver bit 602 that again has a hexagonal cross section, but where the cross-section is reduced compared to that of the bits 512, 514, and 550 shown in FIGS. 21-28. With the reduced cross section, flat surfaces 604 of the bit 602 are sufficiently short relative to the size of a conductor 606 (shown in FIG. 30) to be bent therearound that they act as an effectively circular cross-section, allowing the conductor 606 to be bent about the bit 602 in the same manner as it would about a cylindrical post. The corners of the flat surfaces 604 provide an intermittent line of contact 608 (shown in FIG. 29) that provides an effective contact radius $R_C$ defined as the radius of a circle circumscribing the flat surfaces 604, as shown in FIG. 30. The height of the bit 602 can be selected to allow the tool 600 to provide a winding function in addition to aiding the user in forming consistent conductor loops. While not illustrated, it should be appreciated that a tool of the present invention could be formed with an off-axis post having a cross-section that is polygonal, rather than cylindrical; for example, forming the off-axis post with a hexagonal cross-section may facilitate fabrication, since a greater range of sizes of hexagonal stock of suitable material may be commercially available compared to cylindrical stock of material having the desired characteristics. In such cases, the off-axis post effective radius $R_O$ will be the radius of a circle circumscribing the hexagonal cross section.

Figure 31:
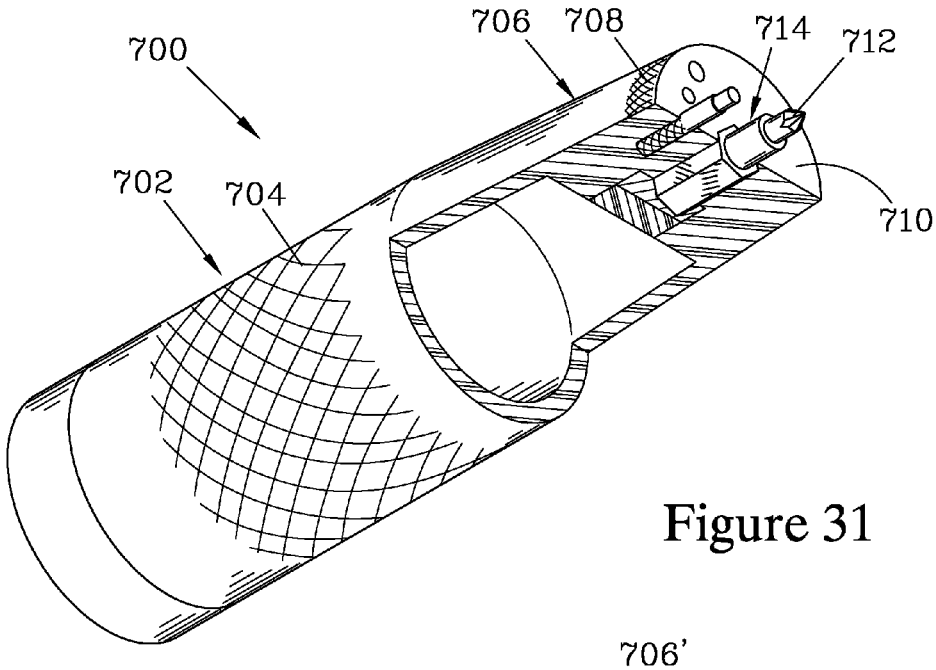
FIG. 31 illustrates another embodiment of the present invention, a loop-forming tool that is similar to that shown in FIGS. 21 and 22, but where the grip is provided with knurling to facilitate grasping the grip to apply torque.
Figure 32:
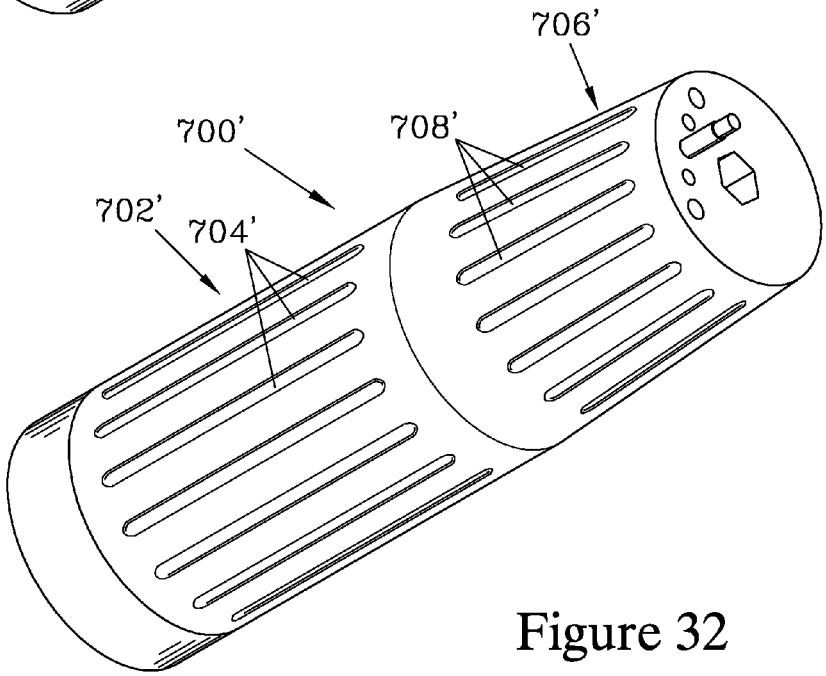
FIG. 32 illustrates an embodiment similar to that shown in FIG. 31, but where grooves are employed to facilitate grasping the grip.

FIGS. 31 and 32 illustrate two loop-forming tools (700, 700') that are similar to either of the loop forming tools (500, 500') shown in FIGS. 21-28, but which have features to facilitate a user grasping a grip (702, 702') to apply torque to the tool (700, 700').

The grip 702 of the tool 700 shown in FIG. 31 has a knurled handle portion 704 that facilitates a user attaining a firm grasp on the grip 702. The grip 702 also has a first end section 706 having a forward knurled portion 708 in close proximity to a grip terminal surface 710. The forward knurled portion 708 allows a user to apply torque to the first end section 706 using a thumb and forefinger, while the remainder of the grip 702 is loosely cradled in the hand of the user; this allows a user to readily tighten screws using a screwdriver bit 712 formed on a central post 714.

The grip 702' of the tool 700' shown in FIG. 32 provides a similar function, but employs a series of grooves 704' on the grip 702' to allow a user to firmly grasp the grip 702', and employs a forward series of grooves 708' on a first end section 706' to allow a user to readily apply torque to the first end section 706' with a thumb and forefinger.

Figure 33:
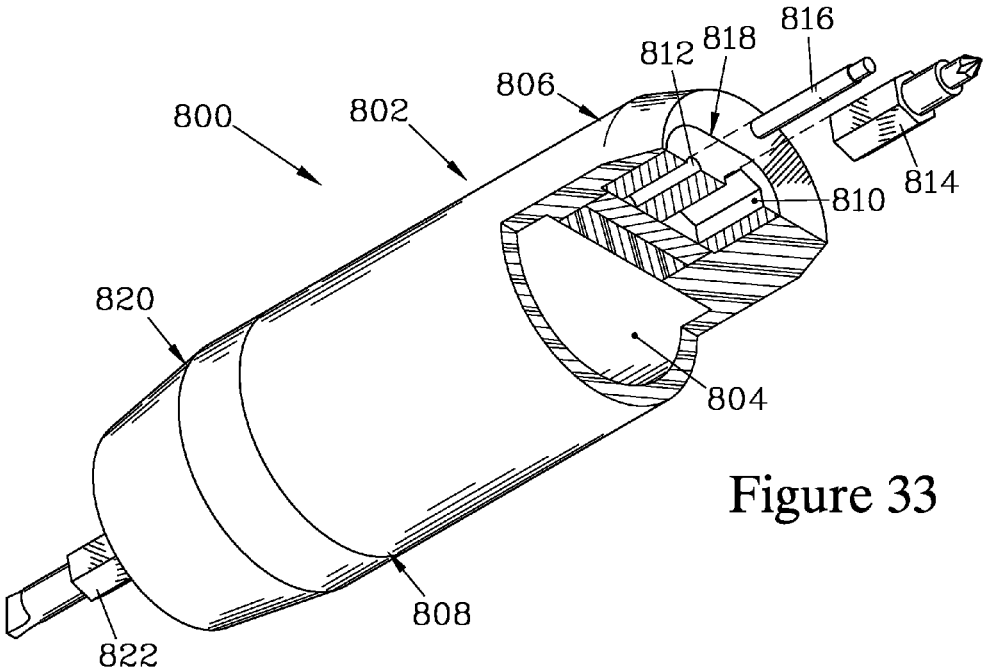
FIGS. 33 and 34 illustrate another embodiment of the present invention having a hollow grip closed at a first end section so as to form a grip cavity. The first end section has sockets for a central post and an off-axis post. The posts are configured to slidably engage the sockets. The central post is further configured so as to have a central post exposed section that is cylindrical and terminates in a terminal section which forms a screwdriver. A cap is provided which engages a second end section of the grip and this cap has a socket configured to accept a post of the type employed for the central post. The grip cavity can be employed to store the posts when the handle is not in service, allowing the grip to be employed with alternative posts to increase the functionality of the tool.
Figure 34:
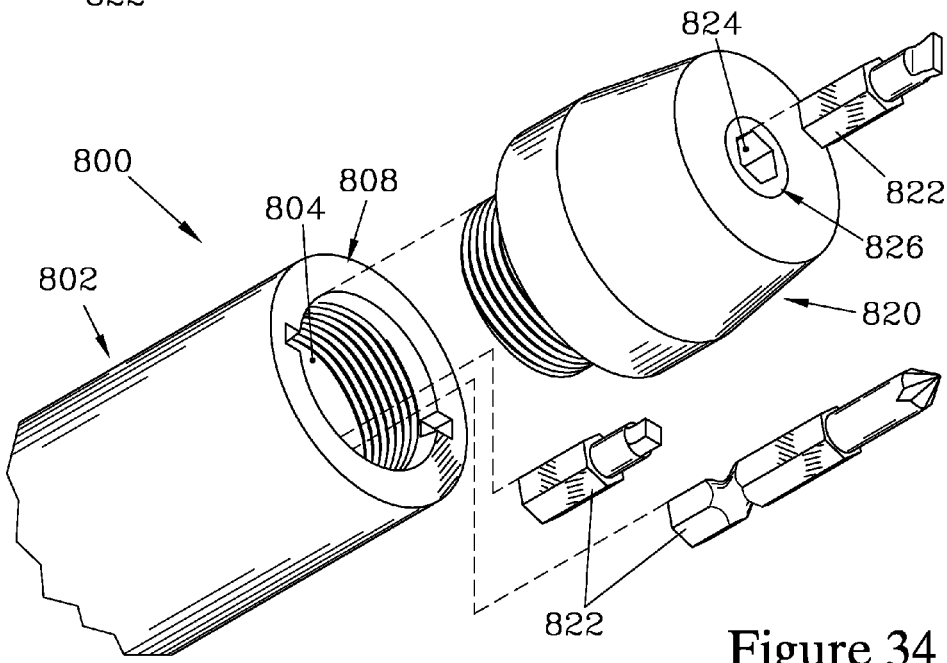

FIGS. 33 and 34 illustrate a looping and winding tool 800 which is functionally similar to the looping and winding tool 500 shown in FIGS. 21 and 22, but which is better suited for use as a conventional screwdriver in addition to serving as a looping and winding tool. The tool 800 again has a grip 802 that is hollow, providing a grip interior space 804, and terminating at a first end section 806 and a second end section 808. The first end section 806 is provided with a pair of sockets 810 and 812 that respectively receive a central post 814 and an off-axis post 816. Again, the central socket has a hexagonal cross section so that it will accept the shank of the central post 814. As illustrated, these sockets (810, 812) are part of a reinforced insert 818 mounted in the grip first end section 806. Having the central post 814 embedded in the reinforced insert 818 allows the user to apply greater torque when the central post 814 is designed to function as a driver while still allowing the grip 802 to be formed from an inexpensive, lightweight material such as plastic.

The second end section 808 is closed by a removable cap 820 to allow the posts (814, 816) and any screwdriver bits 822 to be stored therein. The ability to remove the off-axis post 816 as well as the central post 814 allows the user to remove all protrusions from the grip first end section 806 when it is desired to use the tool 800 with a screwdriver bit 822 mounted in a cap socket 824 provided in the cap 820. The cap socket 824 is provided in a reinforced cap insert 826 to accommodate greater torque being applied with the screwdriver bit 822 mounted therein.

While the novel features of the present invention have been described in terms of particular embodiments and preferred applications, it should be appreciated by one skilled in the art that substitution of materials and modification of details can be made without departing from the spirit of the invention.

What I claim is:

1. A conductor loop-forming tool for forming a loop of desired size and shape in a conductor wherein the loop includes a free end of the conductor and is configured to be readily installed about a portion of a tie-down post, the loop-forming tool comprising:

a grip having a grip axis and terminating in a grip first end section having a substantially planar grip terminal surface;

a central post having a central post axis that is substantially aligned with said grip axis, said central post having a central post embedded section and a central post exposed section, said central post embedded section being mounted in said grip first end section and said central post exposed section terminating in a central post free end that is spaced apart from said grip terminal surface, said central post exposed section being further configured so as to form, in combination with said grip terminal surface, a conductor bending cradle for bending a portion of the conductor about a portion of said central post exposed section that is configured to provide a line of contact with the conductor, said line of contact having a contact radius $R_C$ for the conductor;

an off-axis post having an off-axis post axis, said off-axis post being partially embedded in said grip first end section with said off-axis post axis parallel to and spaced apart by a separation S from said central post axis, said off-axis post terminating in an off-axis post free end spaced apart from said grip terminal surface to form an off-axis post exposed section, wherein said off-axis post has an off-axis post effective radius $R_o$ and the separation S is sufficient to allow the conductor to be passed between said central post and said off-axis post; and a hook length indexing mark on said grip terminal surface located at a distance from said central post and positioned with respect to said off-axis post so as to indicate a position for the free end of the conductor when the conductor passes between said posts and extends sufficiently far as to be engaged by said off-axis post when bent around said central post by rotation of said grip and to define a desired hook length $L_H$ to establish a consistent loop tail size.

2. The conductor loop-forming tool of claim 1 further comprising:

an initial bend indexing mark on said grip terminal surface positioned with respect to said hook length indexing mark and said posts such that, when a conductor superimposed over said hook length indexing mark is bent about said central post by rotation of said grip sufficiently to be superimposed over said initial bend indexing mark, a 180° bend is formed in the conductor to assure uniform loop breadth and degree of bend to form a U-shaped loop in the conductor.

3. The conductor loop-forming tool of claim 1 further comprising:

a reverse bend indexing mark on said grip terminal surface for assuring a consistent cant between the loop and a remaining portion of the conductor when the conductor has been bent about said central post exposed section to form a U-shaped loop and is subsequently bent against said off-axis post exposed section to convert the U-shaped loop into a "?"-shaped hook.

4. The conductor loop-forming tool of claim 1 further comprising:

an auxiliary hook length indexing mark that is a reflected image of said hook length indexing mark with respect to a plane defined by the post axes, said auxiliary hook length indexing mark also serving to indicate a consistent cant between the loop and a remaining portion of the conductor when the conductor has been initially bent about said central post exposed section to form a U-shaped loop and is then bent against said off-axis post exposed section to convert the U-shaped loop into a "?"-shaped hook.

5. The loop-forming tool of claim 1 wherein said hook length indexing mark is positioned with respect to said posts to define the hook length $L_H$ such that $L_H$ is at least ⅜" and not more than about 7/16".

6. The loop-forming tool of claim 1 wherein said central post free end is configured to provide a screwdriver.

7. The loop-forming tool of claim 6 wherein said central post embedded section slidably engages said grip first end section, said grip further comprising:

means for retaining said central post in said grip first end section.

8. The loop-forming tool of claim 7 for use when the conductor has a conductor diameter $D_C$, wherein said central post is configured such that said central post exposed section provides a notch having a contact line engaged by the conductor so as to define the contact radius $R_C$ measured at the contact line, said notch having a notch height $H_N$ that is greater than the conductor diameter $D_C$.

9. The loop-forming tool of claim 6 wherein said central post exposed section is formed by a cylinder of radius $R_C$.

10. The loop-forming tool of claim 6 wherein said central post exposed section has a polygonal cross-section defined by a polygon inscribed within a circle of radius $R_C$.

11. A conductor loop-forming and winding tool for forming a loop in a conductor and winding the loop about a shank portion of a tie-down bolt when installed thereabout so that a portion of the conductor resides under a retaining head of the tie-down bolt, the loop-forming tool comprising:

a grip having a grip axis and terminating in a grip first end section having a substantially planar grip terminal surface;

a central post having a central post axis that is substantially aligned with said grip axis, said central post having a central post embedded section and a central post exposed section, said central post embedded section being mounted in said grip first end section and, said central post exposed section having a central post exposed height $H_C$ and terminating in a central post free end that is spaced apart from said grip terminal surface, said central post exposed section having a central post effective radius $R_C$, said central post exposed section thereby providing, in combination with said grip terminal surface, a conductor bending cradle for bending a portion of the conductor when the conductor is held and said grip is rotated;

an off-axis post having an off-axis post axis, said off-axis post being partially embedded in said grip first end section with said off-axis post axis parallel to and spaced apart by a separation S from said central post axis, said off-axis post terminating in an off-axis post free end configured to be rotatably engageable with the retaining head of the tie-down post and being spaced apart from said grip terminal surface to form an off-axis post exposed section having an off-axis post exposed height $H_O$, wherein said off-axis post has an off-axis post effective radius $R_O$ and the separation S is sufficient to allow the conductor to be passed between said central post and said off-axis post; and further wherein said off-axis post exposed height $H_O$ is less than said central post exposed height $H_C$ and the difference in height is such that ( $H_C$–$H_O$) is at least 3/32" and not more than ¼", whereby, when said off-axis post free end is engaged with the retaining head of the tie-down post, said central post extends beyond the retaining head a sufficient distance to engage the conductor and force a portion of the conductor under the retaining head as said grip is rotated.

12. The conductor loop-forming and winding tool of claim 11 wherein said central post exposed height $H_C$ is no greater than 1".

13. The conductor loop-forming and winding tool of claim 12 wherein the retaining head has a head diameter D and a head socket, the tool further comprising:

an off-axis post terminal section of said off-axis post that terminates in said off-axis post free end, said off-axis post terminal section having an off-axis terminal radius $R_{OT}$ that is less than the off-axis post effective radius $R_O$ and is selected to allow said off-axis terminal section to rotatably engage the head socket of the tie-down bolt;

a central post terminal section of said central post that terminates in said central post free end, said central post terminal section having a central post terminal radius $R_{CT}$ selected such that, $2*(S-R_{CT})$ is greater than D.

14. The conductor loop-forming and winding tool of claim 13 wherein $R_C>R_O$ and $R_C>R_{CT}$.

15. The conductor loop-forming and winding tool of claim 14 wherein said central post terminal section of said central post is configured to serve as a screwdriver.

16. The loop-forming and winding tool of claim 15 wherein said central post embedded section slidably engages said grip first end section, said grip further comprising:

means for retaining said central post in said grip first end section; and means for limiting rotation between said central post and said grip first end section.

17. The loop-forming tool of claim 11 further comprising:

a hook length indexing mark on said grip terminal surface for aiding a user in positioning a free end of the conductor relative to said posts so as to establish a consistent loop tail size.

18. A conductor loop-forming and winding tool for forming a loop in a conductor and winding the loop about a shank portion of a tie-down bolt when installed thereabout so that a portion of the conductor resides under a retaining head of the tie-down bolt, the loop-forming tool comprising:

a grip having a grip axis and terminating in a grip first end section having a substantially planar grip terminal surface;

a central post having a central post axis that is substantially aligned with said grip axis, said central post having a central post embedded section and a central post exposed section, said central post embedded section being mounted in said grip first end section and, said central post exposed section having a central post exposed height $H_C$ and terminating in a central post free end that is spaced apart from said grip terminal surface, said central post exposed section having a central post effective radius $R_C$, said central post exposed section thereby providing, in combination with said grip terminal surface, a conductor bending cradle for bending a portion of the conductor when the conductor is held and said grip is rotated;

an off-axis post having an off-axis post axis, said off-axis post being partially embedded in said grip first end section with said off-axis post axis parallel to and spaced apart by a separation S from said central post axis, said off-axis post terminating in an off-axis post free end configured to be rotatably engageable with the retaining head of the tie-down post and being spaced apart from said grip terminal surface to form an off-axis post exposed section having an off-axis post exposed height $H_O$, said off-axis post having an off-axis post base section that intersects said grip terminal surface and has an off-axis post effective radius $R_O$, and said off-axis post free end terminating an off-axis post terminal section having an off-axis terminal radius $R_{OT}$ that is less than the off-axis post effective radius $R_O$, wherein the separation S is selected with respect to said central post effective radius $R_C$ and said off-axis post effective radius $R_O$ so as to provide sufficient separation between said central post exposed section and said off-axis post base section to allow the conductor to be passed therebetween; and further wherein said off-axis post exposed height $H_O$ is less than said central post exposed height $H_C$, whereby, when said off-axis post free end is engaged with the retaining head of the tie-down post, said central post extends beyond the retaining head a sufficient distance to engage the conductor and force a portion of the conductor under the retaining head as said grip is rotated.

19. The conductor loop-forming and winding tool of claim 18 for use when the retaining head of the tie-down bolt has a head socket, wherein the off-axis terminal radius $R_{OT}$ of said off-axis post terminal section is selected such that said off-axis post terminal section is rotatably engagable with the head socket of the tie-down bolt.

20. The conductor loop-forming and winding tool of claim 19 wherein said central post terminal section of said central post is configured to serve as a screwdriver.

* * * * *